United States Patent [19]

Sondy

[11] 4,001,799

[45] Jan. 4, 1977

[54] KILN ALARM

[76] Inventor: Dominic P. Sondy, 1609 Mills Ave., North Muskegon, Mich. 49445

[22] Filed: July 9, 1975

[21] Appl. No.: 594,329

[52] U.S. Cl. ..... 340/213 Q; 200/61.08; 337/402; 337/404

[51] Int. Cl.[2] ..... H01H 37/76; G08B 29/00

[58] Field of Search ..... 337/401, 403, 404, 416, 337/406; 200/61.08; 340/213 Q, 227.1

[56] References Cited

UNITED STATES PATENTS

| | | | |
|---|---|---|---|
| 2,555,864 | 6/1951 | Strange | 337/404 |
| 2,675,600 | 4/1954 | Dawson | 337/416 X |
| 3,287,530 | 11/1966 | Dawson | 337/416 X |
| 3,838,377 | 9/1974 | Vukovich | 337/416 |

*Primary Examiner*—George Harris

*Attorney, Agent, or Firm*—Price, Heneveld, Huizenga & Cooper

[57] ABSTRACT

An apparatus activates an alarm when the heat and temperature provided by a kiln reach a predetermined level. The apparatus includes a tube extending through the wall of the kiln. An integral mounting surface at the end of the tube inside the kiln provides a surface upon which can rest a pyrometric cone. An elongated member extends through the bore of the tube resting on the pyrometric cone at one end and secured to a pivot point at the other end outside of the kiln. An alarm switch is mechanically coupled to the elongated member. When the elongated member descends because the cone deforms an alarm is activated.

10 Claims, 3 Drawing Figures

KILN ALARM

BACKGROUND OF THE INVENTION

1. Field of the Invention

This invention relates to apparatus for automatically activating an alarm when the heat of a kiln reaches a pedetermined level.

2. Description of the Prior Art

Kilns are used by ceramic artists and hobbyists for the firing of ceramic products. Various automatic control systems for turning off kilns are known. Typically, an element of such a control system is a pyrometric cone composed of a fusible material which deforms upon exposure to a predetermined amount of heating. The deforming of the cone permits movement of a lever activating a shut off mechanism. An automatic shut off system when a predetermined level of heating is reached in a kiln as disclosed in U.S. Pat. No. 2,675,600 issued to W. P. Dawson on Apr. 20, 1954. The melting or deforming of the cone permits a lever to move and to release a weighted arm which swings downward by gravity. The weighted arm is mounted to the outside of the kiln. The moving lever in the Dawson patent is pivoted at an intermediate point between the one end of the lever resting on the cone and the other end of the lever restraining the swinging weighted arm. Two brackets are inserted into slots in an interior end of a ceramic tube to support the cone. A relatively small torque is available to cause movement of the lever to release the weighted arm because the lever is almost at balance about the pivot point. A somewhat longer extension of the lever from the pivot point to the tyrometric cone than from the pivot to the weight releasing end causes the weight releasing end to move upward.

U.S. Pat. No. 2,555,864 issued to C. H. Strange on June 5, 1951 discloses a similar system which utilizes the collapse or melting of a pyrometric cone to move a rod and to actuate an electric switch which then energizes an electric device which can shut off the heat supply to the kiln and energize a warning signal. As before, a special support is required for the pyrometric cone and relatively little torque can be produced by the pivoting rod.

SUMMARY OF THE INVENTION

An apparatus in accordance with an embodiment of this invention includes a tube inserted through a kiln wall into the kiln and having a cut out section from the end of the tube inside the kiln. Without the cut out section, the tube provides integral support surfaces for a pyrometric cone. No additional supports for the pyrometric cone need be constructed inside the kiln. This saves material and the fabrication step of attaching any supports to the inside wall of the kiln or to the tube and results in a cost saving. A lever extends through the bore of the tube and has an end resting on the pyrometric cone. Typically, the pyrometric cone extends horizontally across the bore of the tube. The other end of the lever extends through the tube to the outside of the kiln and is pivoted outside the kiln. At an intermediate point between the pivot point and the cone, a weight is attached to the lever to provide a force to actuate a switch. The weight permits the lever to accurately follow the deformation of the cone. Such a weight is desirable to overcome greater resistive forces when actuating a switch and allows more positive movement of the lever.

Deformation of the cone results in the weight travelling downward and striking a switch and closing the contacts of the switch. The switch completes a circuit which activates an alarm device. This combination of the switch and the alarm device is advantageous because it is relatively low cost and does not involve any high amperage relay switches to cut off power to the kiln. Further, the switch can be spaced from the exterior wall of the kiln. This is advantageous because such spacing reduces the amount of heat to which the switch is exposed. Exposing the switch to less heat permits less rugged construction and a resulting cost saving. An apparatus in accordance with an embodiment of this invention makes possible efficient use of the kiln because the operator of the kiln is notified when each firing is complete and the next firing can commence. If no further firings are desired the power supply to the kiln can be turned off manually.

DETAILED DESCRIPTION

Figure 1:
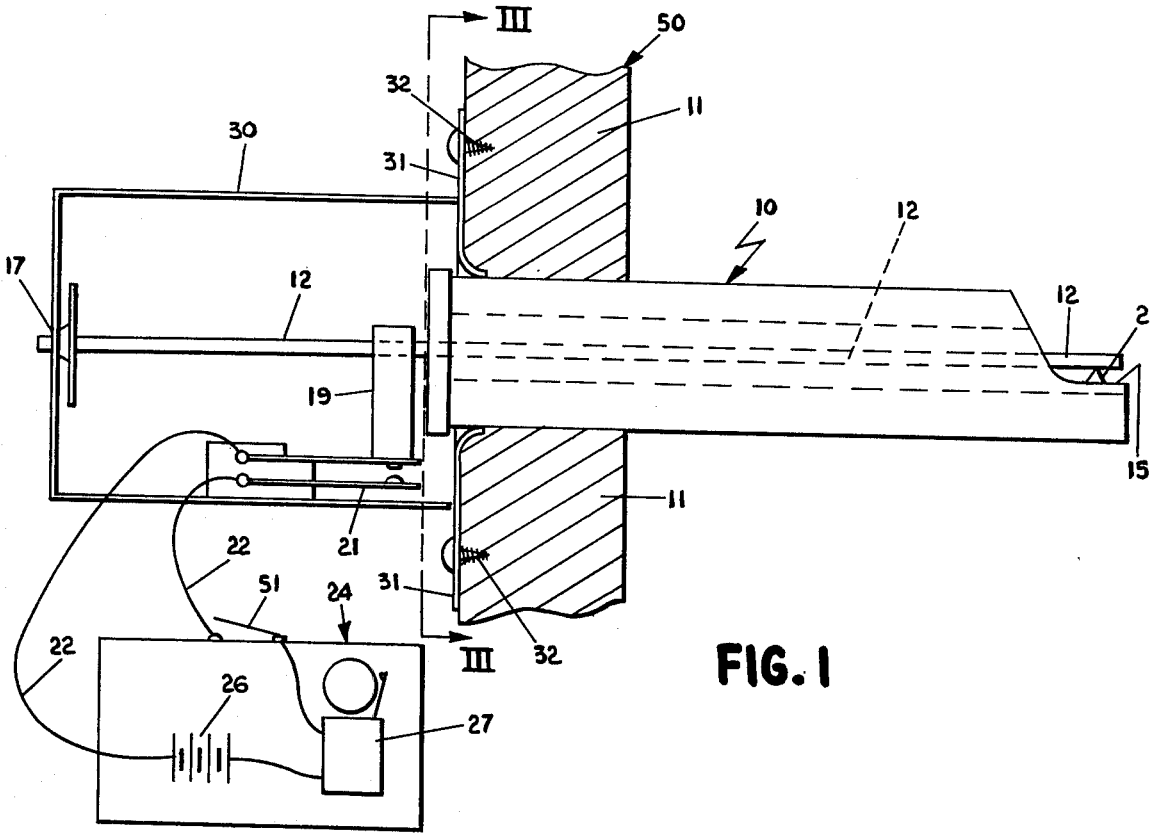
FIG. 1 is a cross-sectional view of a kiln alarm in accordance with an embodiment of this invention.
Figure 3:
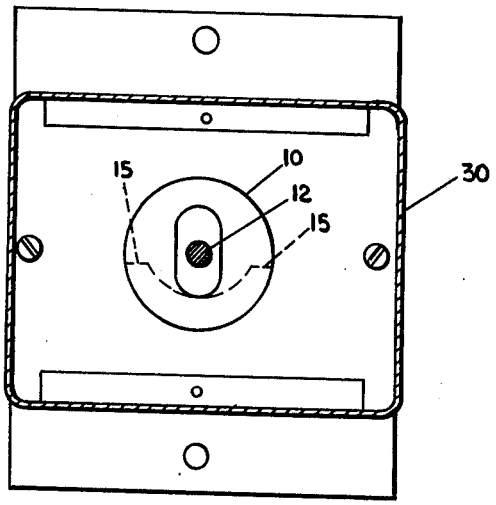
FIG. 3 is a cross-sectional view along section line III—III of FIG. 1 of a kiln alarm in accordance with an embodiment of this invention.
Figure 2:
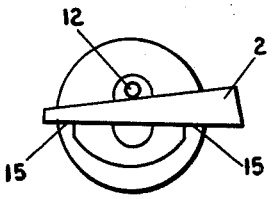
FIG. 2 is a partial end view of a kiln alarm in accordance with an embodiment of this invention.

Referring to the drawings, a tube 10 is provided to extend through a kiln wall 11 and into the central opening of a kiln 50. In a preferred embodiment, tube 10 is constructed from black iron pipe, but it can be constructed from other materials such as a clay or a ceramic. A rod 12 extends through the bore of tube 10. A section of tube 10 is removed to produce horizontal surfaces 15 at the end portion of tube 10 in the interior of kiln 50. Thus, an integral cone support can be simply formed without the need for separate mounting of the supporting surface. For example, if a section of the top half of tube 10 near the interior end is removed, a bottom semi-circular portion is left. At the extremities of the semi-circular portion are horizontal surfaces 15 suitable for supporting cone 2 in a generally horizontal position. Further, once rod 12 is aligned within tube 10, rod 12 is automatically aligned with supporting horizontal surfaces 15. Separate cone supports would of course require a separate alignment step with tube 10 and rod 12. A pyrometric cone 2 can be placed on horizontal surfaces 15 and across the interior end opening of tube 10. The end of rod 12 can rest on cone 2. Rod 12 is pivoted at its end outside of kiln 50 by a support 17. Secured to rod 12 at a point between the pivot point and the end of rod 12 inside kiln 50 is a weight 19. Weight 19 is located outside kiln 50 and is mounted above a switch mechanism 21.

Connected to switch mechanism 21 through wires 22 is an alarm device 24. For example, alarm device 24 can contain a power source 26 and a bell 27. Wires 22 are suitable for carrying an electric current and are advantageously sufficiently long to permit placing of alarm device 24 in a convenient location where the alarm can readily be heard. Thus, an operator can leave the area where the kiln is located and still hear the alarm thereby knowing when to return to turn the kiln off. A system switch 51 can be provided in series with alarm device 24 and switch 21. System switch 51 can be opened when it is desired to inactivate alarm device 24 regardless of the position of rod 12. Typically, this would be done when the kiln is not being fired and there is no cone 2 placed on surfaces 15. Without system switch 51, there would be a continuous sounding of bell 27 if there were no cone 2 to support rod 12.

The elements of the alarm device outside and mounted to the kiln can be enclosed within a box 30. Box 30, in turn, can be attached to plate 31 which is mounted by a means of screws 32 to the outside of kiln 50 on kiln wall 11. Plate 31 can also support and be attached to tube 10. Typically, switch 21 is mounted in box 30. In a typical construction, a metal material is used for box 30, rod 12, weight 19 and pivot support 17.

OPERATION

In preparation for firing kiln 50, a cone 2 is placed on surfaces 15 across the opening of tube 10 and rod 12 is placed on cone 2. System switch 51 is closed to configure alarm device 24 for activation by switch 21. The heating of the kiln causes cone 2 to deform at a predetermined rate. Typically, the deformation rate of cone 2 is chosen with regard to the material which is being fired in the kiln at a predetermined temperature. As cone 2 deforms, the end of rod 12 on cone 2 travels downward. Weight 19 urges this downward movement about pivot support 17. Cone 2 is chosen so that when it has deformed sufficiently to allow switch 21 to close, the correct amount of heat has been produced in the kiln to fire the materials in the kiln and the proper temperature has been reached in the kiln. Closing of switch 21 activates an alarm. Upon perceiving the alarm, the operator of the kiln can shut off the heat source to the kiln. The fired materials are protected from overfiring and the kiln readied for another firing with no wasted time. The protection from overfiring, the reduction in wasted time and the use of low power circuitry for signaling are particularly advantageous. Clearly, a switching mechanism to provide an alarm can be simpler, less rugged and less expensive than a switching mechanism to shut off a heat source, such as an electric heating coil.

Various modifications and variations will no doubt occur to those skilled in the various arts to which this invention pertains. For example, the coupling between the moving weight and the switch can vary from that disclosed herein. The bell indicator can be replaced by a light indicator or an audio-visual combination indicator. These and all other variations which basically rely on the teachings through which this disclosure has advanced the art are properly considered within the scope of this invention.

The embodiments of the invention in which an exclusive property or privilege is claimed are defined as follows:

1. In combination with a kiln, an alarm system including:

an elongated member pivotally mounted outside the kiln and extending into the kiln;

a tube surrounding the extension of the elongated member into the kiln and having a partially removed end portion to provide an arced integral sector providing spaced mounting surfaces for horizontally supporting the ends of an elongated pyrometric cone used to support an end of the elongated member; and a signaling device mechanically coupled to the elongated member and activated by downward sagging of the elongated member resulting from the deformation of said pyrometric cone.

2. An alarm system as recited in claim 1 wherein the tube having a partially removed end portion comprises:

a horizontal surface extending from the end of the tube in the kiln toward the other end of the tube, the surface being located below the top of the opening in the tube; and an inclined surface connecting the top of the tube to the horizontal surface.

3. An alarm system as recited in claim 2 wherein the signaling device includes:

a weight mounted to the elongated member;

a switch positioned to close by downward displacement of the weight; and a means for signaling, electrically connected in series to the switch.

4. An alarm system as recited in claim 3 wherein the means for signaling includes:

a power source; and a bell electrically connected in series to the power source.

5. In combination with a kiln, an alarm system including an alarm mechanism, a switch electrically connected to the alarm mechanism, and control means for said switch mounted on the kiln and mechanically coupled to the switch to provide for closing of the switch, said control means including:

a tube extending through the kiln wall;

a housing surrounding the end of the tube outside the kiln;

an elongated member extending longitudinally within said tube and into said housing;

means within said housing for pivotally mounting said elongated member;

an extended integral bottom portion of said tube inside the kiln providing a mounting surface for supporting a pyrometric cone; and a weight attached to the elongated member between the pivoted end of the member and the end of the member inside the kiln, the weight aligned above the switch so downward rotational displacement of the weight and the elongated member about the pivot causes the switch to close.

6. An alarm system as recited in claim 5 wherein the extended integral bottom portion of the tube in the kiln provides a horizontal surface extending from the end of the tube in the kiln toward the other end of the tube.

7. An alarm system as recited in claim 6 wherein the pivot point is substantially at an end of the elongated member.

8. An alarm system as recited in claim 7 wherein the signaling device comprises, in series, a power source and a bell.

9. An alarm system as recited in claim 8 further comprising a system switching means in series with the power source, the bell and the switch.

10. An alarm system as recited in claim 9 wherein the tube is made from black iron.

* * * * *